United States Patent [19]

Pate

[11] 4,288,879

[45] Sep. 15, 1981

[54] MATERNITY PILLOW

[76] Inventor: Johnny L. Pate, 514 N.E. 14th Ave., Cape Coral, Fla. 33904

[21] Appl. No.: 72,910

[22] Filed: Sep. 6, 1979

[51] Int. Cl.[3] ..... A47G 9/00; A61G 7/00

[52] U.S. Cl. ..... 5/431; 5/462

[58] Field of Search ..... 5/431, 433, 435, 436, 5/465, 462

[56] References Cited

U.S. PATENT DOCUMENTS

| | | | |
|---|---|---|---|
| 1,580,210 | 4/1926 | McCulloch | 5/435 |
| 2,314,080 | 3/1943 | Dine et al. | 5/431 |
| 2,483,222 | 9/1949 | Moss | 5/435 |
| 2,782,427 | 2/1957 | Ericson | 5/436 |
| 2,940,088 | 6/1960 | Boos | 5/446 |
| 3,118,152 | 1/1964 | Talley, Jr. | 5/436 |
| 3,287,747 | 4/1966 | Ellsworth | 5/462 |
| 3,337,884 | 8/1967 | Meir | 297/461 |
| 3,347,544 | 10/1967 | Uffenorde | 5/436 |
| 3,376,070 | 4/1968 | Johnson | 297/459 |
| 3,378,862 | 4/1968 | Skinner | 5/446 |
| 3,924,282 | 12/1975 | Bond | 5/431 |
| 4,021,872 | 5/1977 | Powell | 5/462 |
| 4,054,960 | 10/1977 | Pettit et al. | 5/462 |
| 4,193,150 | 3/1980 | Vineberg | 5/431 |

*Primary Examiner*—Roy D. Frazier
*Assistant Examiner*—Alexander Grosz
*Attorney, Agent, or Firm*—Benjamin P. Reese, II

[57] ABSTRACT

A pillow for support of the expanded abdomen of a pregnant woman during the latter stages of pregnancy. The pillow is substantially wedge-shaped and has an appropriately shaped cavity in its upper surface for receiving and supporting the expanded abdomen of a pregnant woman lying on her side. The pillow is manufactured from foam rubber or another suitable resilient material. The combination of the resilient nature of the pillow and its geometrical configuration comfortably supports the expanded abdomen.

1 Claim, 4 Drawing Figures

MATERNITY PILLOW

BACKGROUND AND SUMMARY OF THE INVENTION

This invention relates to a new and useful pillow for support of the expanded abdomen of a pregnant woman during the latter stages of pregnancy.

It is often difficult for a pregnant woman to sleep and rest during the latter stages of pregnancy. While there are many reasons for this difficulty, one of the principal reasons given by pregnant women and their physicians is the inability of a pregnant woman to comfortably support her expanded abdomen while lying in bed during the latter stages of pregnancy. And, of course, as a pregnant woman approaches full term pregnancy, expansion of her abdomen occurs at a faster rate and it becomes increasingly more difficult for her to obtain the sleep and rest which she requires. Unfortunately, this occurs at a time when the pregnant woman's physician is prescribing increased sleep and rest for the benefit of both the pregnant woman and her unborn child.

In the past, a pregnant woman's only practical alternative was to sleep and rest lying flat on her back during the latter stages of pregnancy. But, it is well known that many people are in the habit of sleeping and resting on either their right side or their left side. It is also well known that one's sleeping and resting habits are usually formed during early childhood. Often a pregnant woman who has been accustomed to sleeping and resting on her side since early childhood cannot comfortably sleep and rest on her back during the latter stages of pregnancy.

U.S. Pat. No. 3,378,862 describes a mattress having a cavity located in the upper surface and configured to receive the expanded abdomen of a pregnant woman so that she is permitted to sleep and rest facing downwardly on the mattress during the latter stages of her pregnancy. Unfortunately, this mattress is not capable of providing adequate support for the expanded abdomen of a pregnant woman when she is lying on her side. Also, this mattress, and any imaginable special mattress, has several inherent disadvantages which would limit its use by pregnant women.

A mattress is too heavy and bulky for a pregnant woman to move it to various locations in her home and to carry it with her to various locations outside her home when she finds it necessary to travel during pregnancy. Notwithstanding the disclosure of a plug in U.S. Pat. No. 3,378,862, it is unlikely that this mattress, or any imaginable special mattress, would be satisfactory for routine use following pregnancy. A mattress is a major purchase and many pregnant women cannot afford to purchase a new mattress during pregnancy if it cannot be used after pregnancy. Of the pregnant women who can afford to purchase a new mattress during pregnancy, many of them would consider the purchase of a relatively expensive special purpose mattress to be frivolous since an existing general purpose mattress would be usable during pregnancy. If the pregnant woman considered purchase of a special purpose mattress frivolous, it is likely that she would forego the purchase notwithstanding the potential for greater comfort during her pregnancy.

These and other disadvantages of a maternity mattress are not inherent in the present invention. The present invention provides a generally wedge-shaped pillow constructed from foam rubber or another suitable resilient material. The upper surface of the pillow has a cavity positioned adjacent to the front surface of the pillow. The cavity is appropriately shaped to receive and support the expanded abdomen of a pregnant woman lying on her side.

The size and weight of the pillow enable a pregnant woman to carry the pillow with her if she must travel during the latter stages of her pregnancy. And, the relative simplicity of the pillow would enable it to be manufactured and sold for a price which most pregnant women can afford to pay. Since the pillow would be relatively inexpensive to purchase and is not a substitute for an existing general purpose item owned by pregnant women prior to their pregnancy, it is unlikely that many pregnant women would consider the purchase of the pillow to be a frivolous one. Accordingly, the pillow of the present invention has potential for widespread use by pregnant women during the latter stages of pregnancy. Use of the pillow of the present invention by a pregnant woman during the latter stages of pregnancy would benefit not only the woman but also her unborn child.

These and many other advantages and features of the present invention will be apparent from the following brief description of drawings, description of the preferred embodiment and claims.

DESCRIPTION OF THE PREFERRED EMBODIMENT

Figure 1:
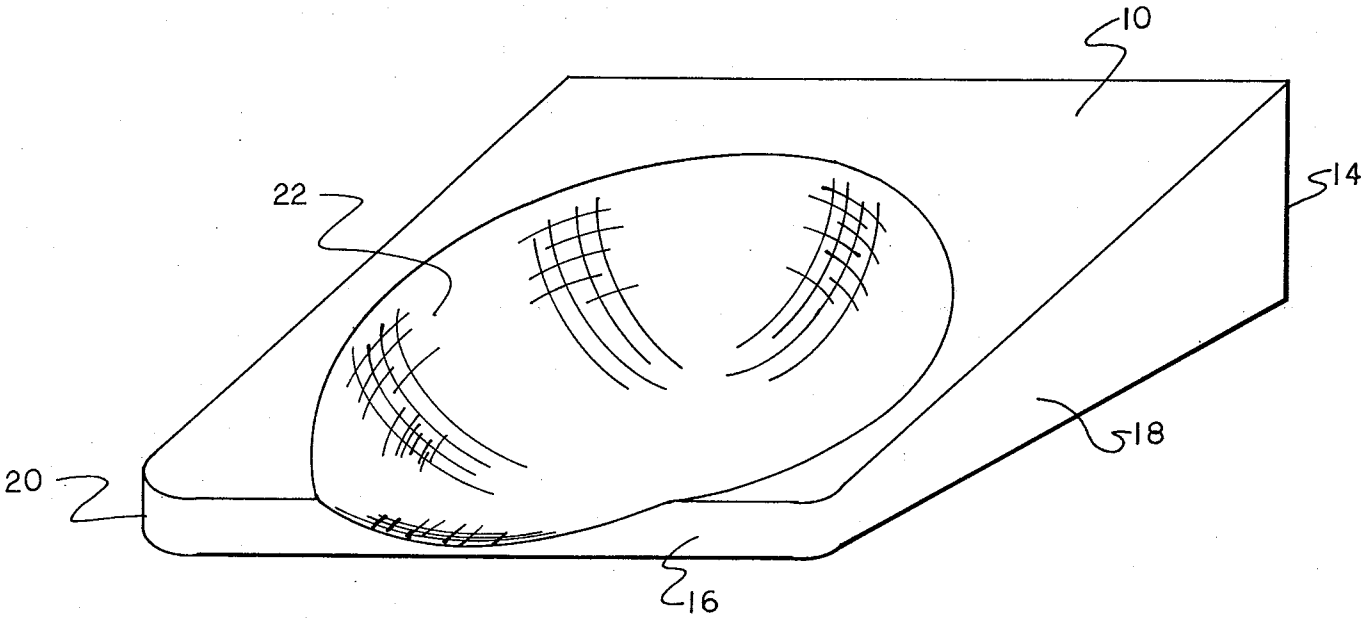
FIG. 1 is a perspective view of the pillow of the present invention.
Figure 2:
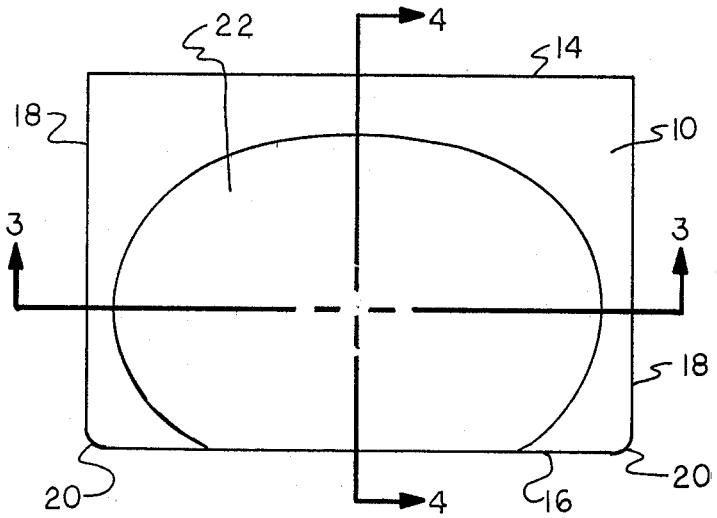
FIG. 2 is a top view of the pillow of the present invention.
Figure 3:
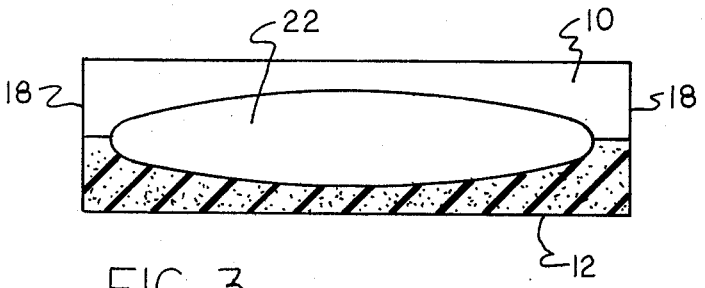
FIG. 3 is a sectional view along the line 3—3 in FIG. 2.
Figure 4:
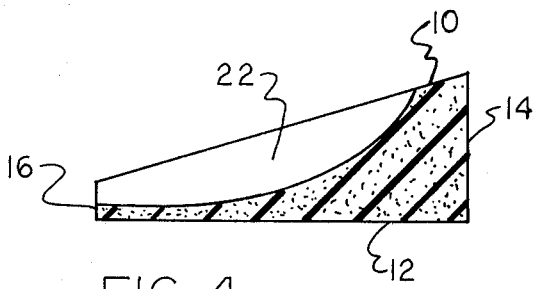
FIG. 4 is a sectional view along the line 4—4 in FIG. 2

The preferred embodiment of the pillow of the present invention is illustrated in FIGS. 1–4.

The pillow of the present invention is preferably manufactured from a single block of foam rubber or another suitable resilient material. Conventional means are used to cut or otherwise shape the resilient material in the desired geometrical configuration. The pillow can be manufactured in several sizes to accommodate pregnant women of various sizes and in different stages of pregnancy. The pillow can be covered with a suitable fabric, if desired.

Referring now to FIGS. 1–4, the pillow is generally wedge-shaped and has an upper surface 10, a lower surface 12, a rear surface 14, a front surface 16 and a pair of identical side surfaces 18. To achieve the desired wedge shape, the height of the rear surface 14 is substantially greater than the height of the front surface 16. While the ratio of the height of the rear surface 14 to the height of the front surface 16 is not fixed, a four to one ratio is typical. Rounded corners 20 are provided at each of the intersections of the front surface 16 and one of the side surfaces 18.

The upper surface 10 of the pillow contains a cavity 22. When viewed in the plane of the upper surface 10, the cavity 22 is generally elliptical in shape with the exception of an essentially straight edge located at the intersection of the upper surface 10 and the front surface 16. Ideally, the three-dimensonal shape of the cavity 22 should identically conform to the shape of the expanded abdomen of the particular pregnant woman using the pillow. Nevertheless, the three-dimensional shape illustrated in FIGS. 1–4 is expected to be comfortable for a large number of pregnant women. The intersection of the cavity 22 and the front surface 16 forms a generally arc-shaped opening to the cavity 22 in the plane of the front surface 16 below the intersection of the upper surface 10 and the front surface 16. Beginning at its opening in the plane of the front surface 16, the cavity 22 becomes progressively deeper when moving along an axis parallel to the side surfaces 18 in the direction of the rear surface 14.

Having described the structure of the pillow of the present invention, its use by a pregnant woman will now be described. First, the pillow is placed on the upper surface of the bed or other structure upon which the pregnant woman desires to sleep or rest. Next, the pregnant woman lies down on the upper surface of the bed or other structure on either her right side or her left side. When lying down, she faces the front surface 16 of the pillow. Then the pregnant woman engages the pillow with her hands and pushes it under her expanded abdomen. The front surface 16 of the pillow is pushed under the pregnant woman's expanded abdomen until the front surface 16 fits comfortably against her body. The rounded corners 20 assure a comfortable fit.

When the pillow is positioned under the pregnant woman's expanded abdomen in the manner described, the pregnant woman can relax and allow the pillow to support her expanded abdomen. The weight of the pregnant woman will cause some compression of the pillow, but the combination of the resilient nature of the foam rubber or other suitable material used to manufacture the pillow and the pillow's geometrical configuration will provide adequate support for the pregnant woman's expanded abdomen. In particular, the height of rear surface 14, the distance between the rearmost location of the cavity 22 and the intersection of the upper surface 10 and the rear surface 14, and the distances between the sidemost locations of the cavity 22 and the intersection of the upper surface 10 and the side surface 18 provide sufficient resilient material at the outermost locations of the pregnant woman's expanded abdomen to provide necessary support for her abdomen. And, the shape of cavity 22 assures that the weight of the expanded abdomen is distributed properly. When the pregnant woman is lying on her right side with the pillow of the present invention in place, the muscles on the left side of her abdomen are relieved from the strain which would normally occur if the pillow is not used to support her abdomen. When she is lying on her left side with the pillow in place, the muscles on the right side of her abdomen are relieved from the strain which would normally occur if the pillow is not used.

While the present invention has been disclosed in connection with the preferred embodiment thereof, it should be understood that there may be other embodiments which fall within the spirit and scope of the invention as defined by the claims.

I claim:

1. A pillow for support of the expanded abdomen of a pregnant woman while she is lying on one of her sides, comprising a substantially wedge-shaped resilient body having a front surface, a rear surface greater in height than said front surface, a pair of identical parallel side surfaces, a lower surface, and an upper surface with an elliptically shaped cavity which intersects said front surface to form a generally arc-shaped opening to said cavity in the plane of said front surface and which becomes progressively deeper along an axis parallel to said side surfaces in the direction of said rear surface.

* * * * *